US008899417B1

(12) United States Patent
Chen et al.

(10) Patent No.: US 8,899,417 B1
(45) Date of Patent: Dec. 2, 2014

(54) TOOL BOX

(71) Applicants: Chao-Ming Chen, Taichung (TW); Chun-Chia Shih, Puyan Township, Changhua County (TW)

(72) Inventors: Chao-Ming Chen, Taichung (TW); Chun-Chia Shih, Puyan Township, Changhua County (TW)

( * ) Notice: Subject to any disclaimer, the term of this patent is extended or adjusted under 35 U.S.C. 154(b) by 0 days.

(21) Appl. No.: 14/072,865

(22) Filed: Nov. 6, 2013

(51) Int. Cl.
*B65D 85/28* (2006.01)
*B25H 3/02* (2006.01)

(52) U.S. Cl.
CPC ..... *B25H 3/026* (2013.01)
USPC ..... 206/375; 206/377; 206/372

(58) Field of Classification Search
USPC ..... 206/375, 377, 379, 372, 373, 747, 749; 211/69, 70.6
See application file for complete search history.

(56) References Cited

U.S. PATENT DOCUMENTS 7,168,559 B2 * 1/2007 Chen ..... 206/373
8,186,510 B1 * 5/2012 Chen ..... 206/375
8,469,190 B1 * 6/2013 Chang ..... 206/372

FOREIGN PATENT DOCUMENTS

TW I339153 B 3/2011

* cited by examiner

*Primary Examiner* — David Fidei
(74) *Attorney, Agent, or Firm* — Alan D. Kamrath; Kamrath IP Lawfirm, P.A.

(57) ABSTRACT

A tool box contains: a body, a lifting mechanism, at least one holder, and a controlling mechanism. The lifting mechanism is fixed on the body and includes a rotating assembly and a guiding member. The rotating assembly has a first end disposed in the body and a second end mounted in the guiding member so as to rotate on the body. The at least one holder is used to hold at least one tool set and is mounted on the rotating assembly of the lifting mechanism, such that the at least one holder is driven by the rotating assembly to lift and rotate. The controlling mechanism includes at least one resilient element for driving the rotating assembly to rotate and a control member disposed in the body, such that the rotating assembly of the lifting mechanism is positioned on the body.

10 Claims, 14 Drawing Sheets

TOOL BOX

FIELD OF THE INVENTION

The present invention relates to a tool box in which at least one holder lifts and rotates so that a user takes and places at least one tool set.

BACKGROUND OF THE INVENTION

Referring to FIG. 1, a conventional tool box 10 contains a body 11 and a cover 12, and the body 11 includes a plurality of slots 111 so as to insert different sizes and types of bits 13, and the cover 12 is pivoted with one side of the body 11 so as to cover the body 11. However, as taking or storing the bits 13, the cover 12 has to be opened, and a space in the body 11 is so narrow that the bits 13 cannot be taken easily.

As shown in FIGS. 2 and 3, a convention tool box is disclosed in TW Patent No. I 339153 and contains a body 20, and the body 20 includes a first holder 21 and a second holder 33 between which a receiving portion 23 is defined; a first seat 24 and a second seat 25 pivoted with two sides of the receiving portion 23. The first seat 24 has plural first slots 241 for inserting a first bit set 28, and between the body 20 and the first seat 24 is fixed a first torsion spring 242 for abutting against the first seat 24. The second seat 25 has plural second slots 251 for inserting a second bit set 29 and a connecting tool 30, and between the body 20 and the second seat 25 is fixed a second torsion spring 252 for abutting against the second seat 25 to rotate.

The first holder 21 has a first button 26 corresponding to the first seat 24 and a second button 27 corresponding to the second seat 25, such that the first seat 24 and the second seat 25 are controlled to retain in the receiving portion 23 of the body 20. As illustrated in FIG. 14, the first button 26 is pressed so that the first seat 24 disengages from the first button 26 and is pushed by the first torsion spring 242 to rotate, hence a user takes the first bit set 28. In addition, when the second button 27 is pressed, the second seat 25 disengages from the second button 27 so that the second torsion spring 252 pushes the second seat 25, hence the user takes the second bit set 29 and the connecting tool 30. Nevertheless, this tool box has the following disadvantages:

1. The first seat 24 and the second seat 25 rotate along the body 20, but they cannot lift upwardly, so the first bit set 28, the second bit set 29, and the connecting tool 30 cannot be taken easily because of a limited operating space.
2. When the user is desired to place the first bit set 28 into the first seat 24 and to take the second bit set 29 out of the second seat 25, one of the first seat 24 and the second seat 25 has to be fixed, thus causing an inconvenient operation.
3. The first seat 24 and the second seat 25 are operated by the first button 26 and the second button 27, thereby increasing production cost.

The present invention has arisen to mitigate and/or obviate the afore-described disadvantages.

SUMMARY OF THE INVENTION

The primary object of the present invention is to provide a tool box in which a lifting mechanism lifts when a rotating member rotates upwardly so as to move away from a body, hence a user takes and places at least one tool set easily.

Further object of the present invention is to provide a tool box in which the at least tool set is alternatively held in a first seat or a second seat easily.

Another object of the present invention is to provide a tool box which is simplified and is produced at low cost.

To obtain the above objectives, a tool box contains: a body, a lifting mechanism, at least one holder, and a controlling mechanism.

The lifting mechanism is fixed on the body and includes a rotating assembly and a guiding member.

The rotating assembly has a first end disposed in the body and a second end mounted in the guiding member so as to rotate on the body.

The at least one holder is used to hold at least one tool set and is mounted on the rotating assembly of the lifting mechanism, such that the at least one holder is driven by the rotating assembly to lift and rotate.

The controlling mechanism includes at least one resilient element for driving the rotating assembly to rotate and a control member disposed in the body, such that the rotating assembly of the lifting mechanism is positioned on the body.

DETAILED DESCRIPTION OF THE PREFERRED EMBODIMENTS

Figure 1:
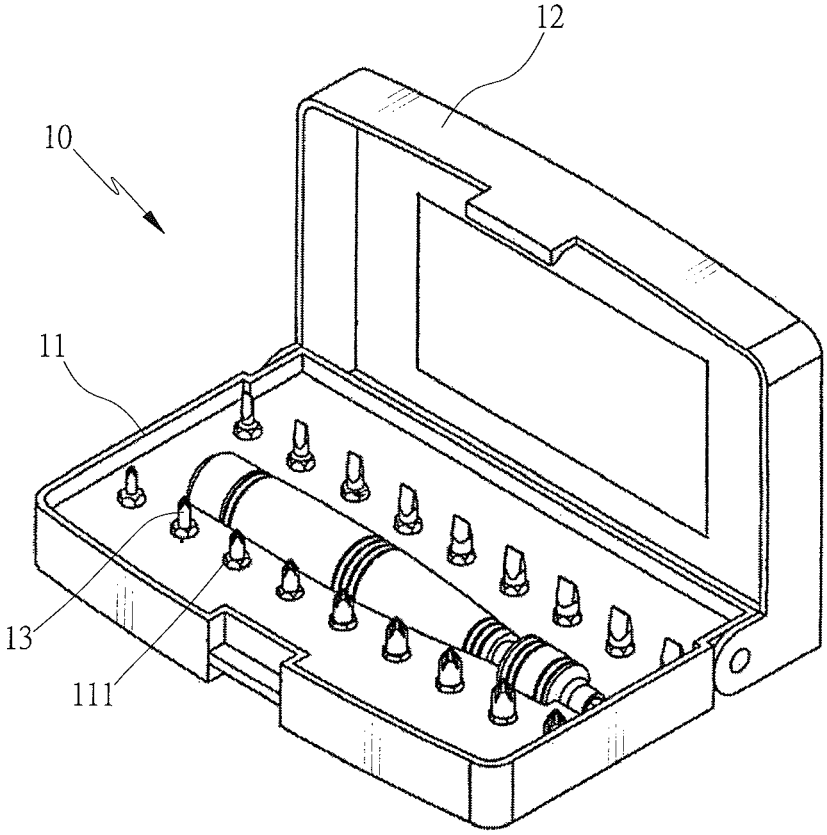
F I G . 1 PRIOR ART
FIG. 1 is a perspective view of a conventional tool box.
Figure 2:
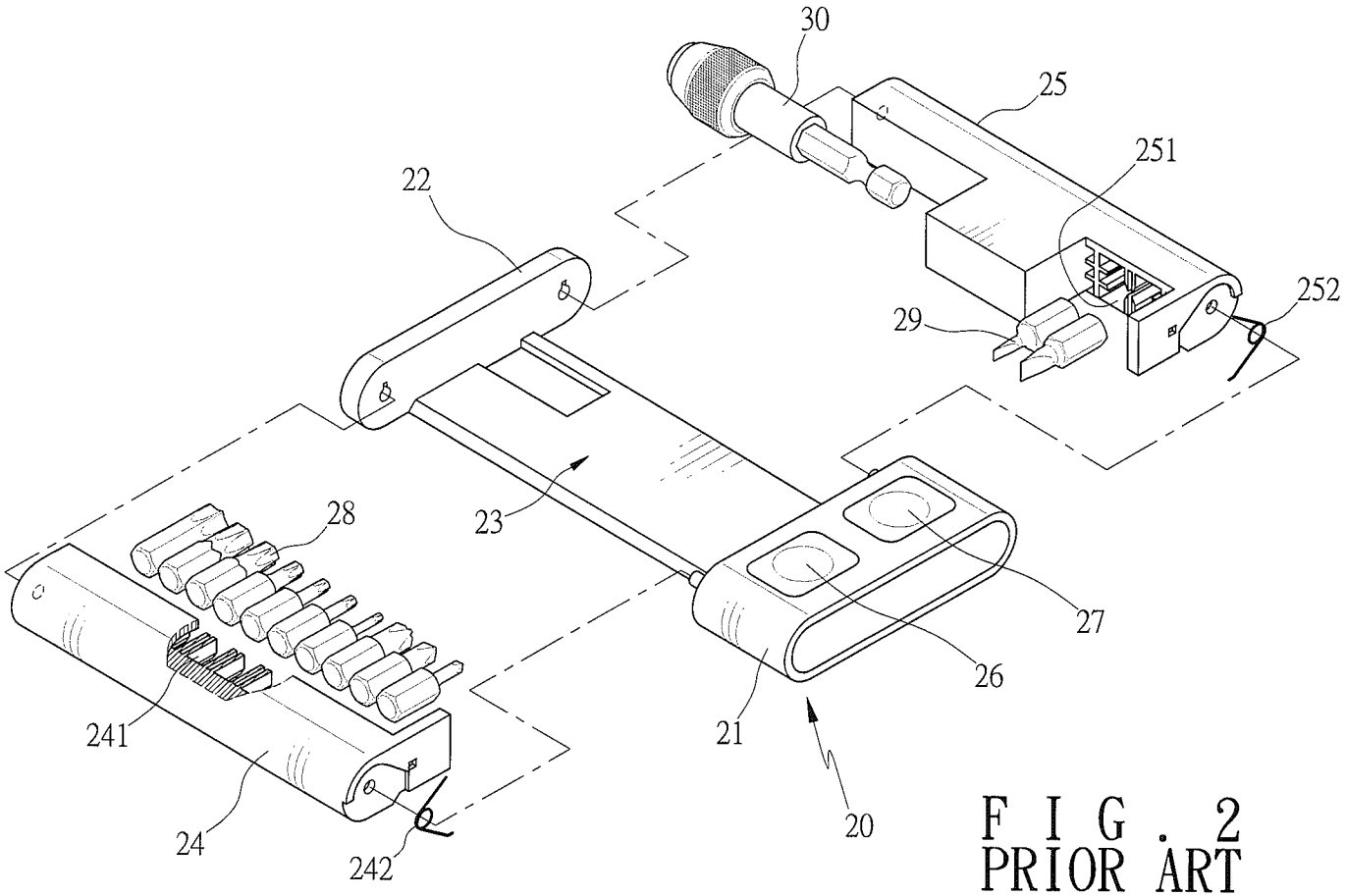
FIG. 2 PRIOR ART
FIG. 2 is a perspective view showing the exploded components of a conventional tool box disclosed in TW Patent No. I 339153.
Figure 3:
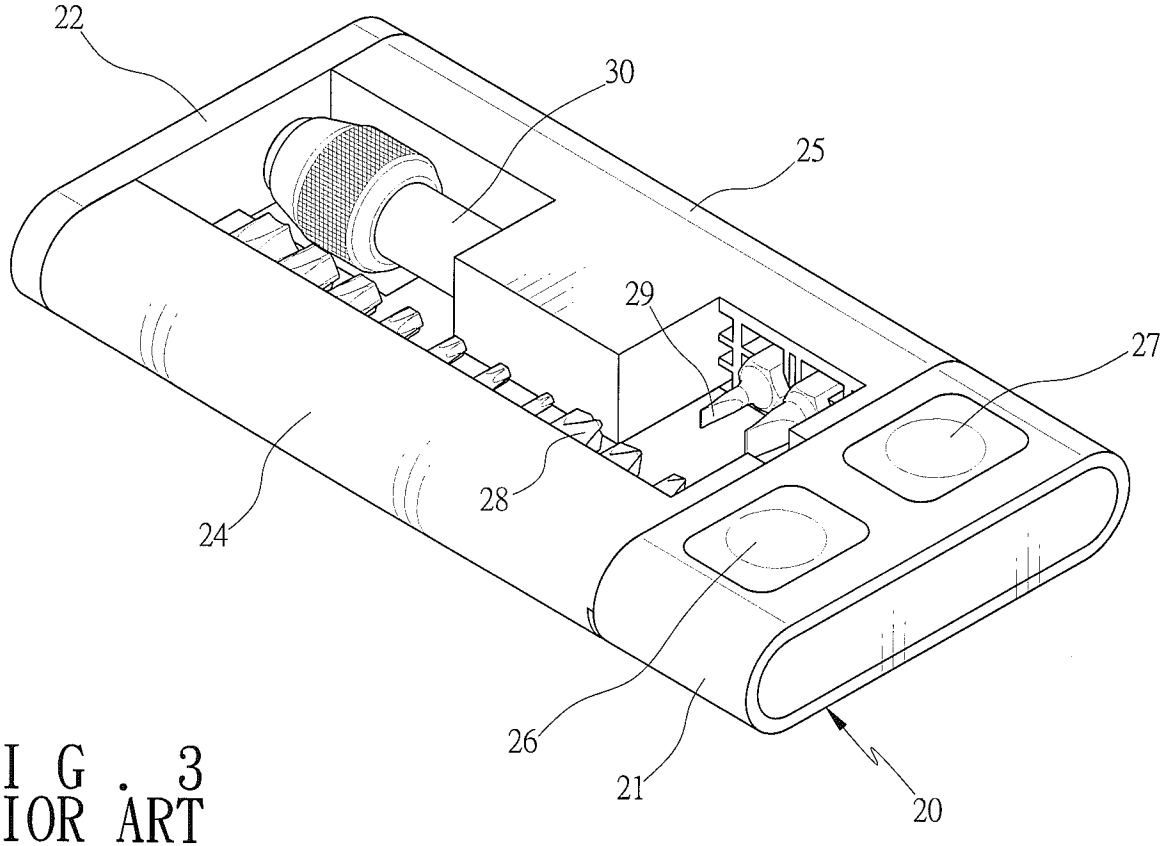
FIG. 3 PRIOR ART
FIG. 3 is a perspective view showing the assembly of the conventional tool box disclosed in TW Patent No. I 339153.
Figure 4:
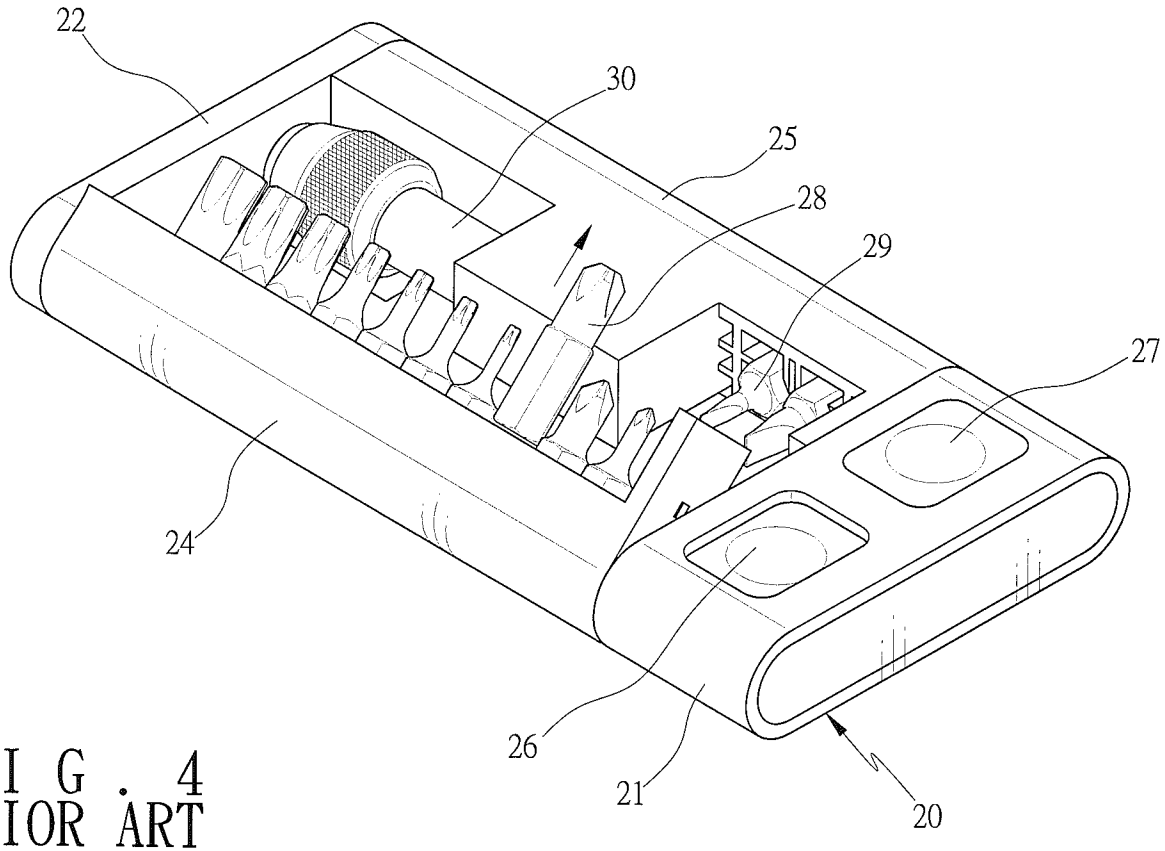
FIG. 4 PRIOR ART
FIG. 4 is a perspective view showing the operation of the conventional tool box disclosed in TW Patent No. I 339153.
Figure 5:
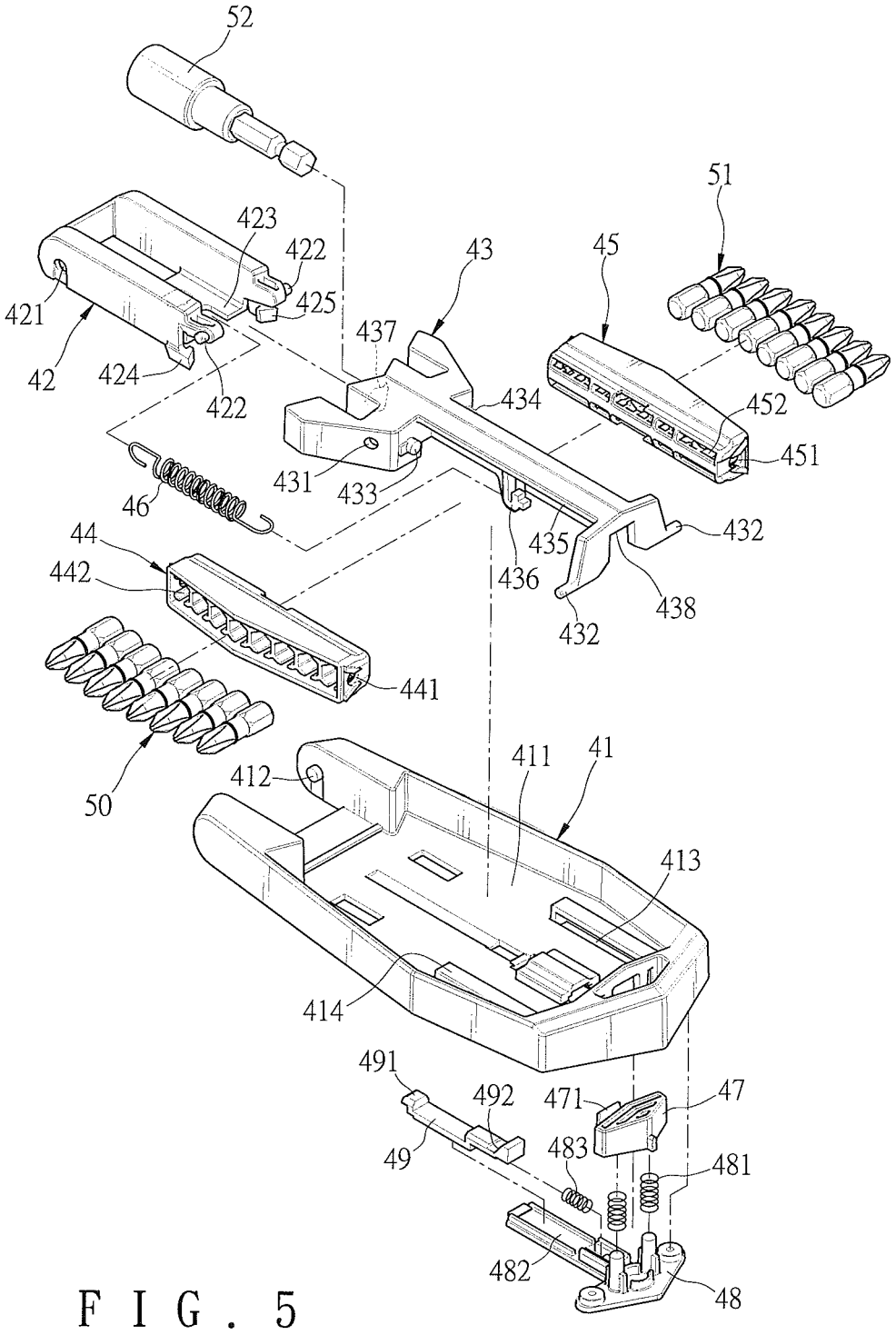
FIG. 5 is a perspective view showing the exploded components of a tool box according to a preferred embodiment of the present invention.
Figure 6:
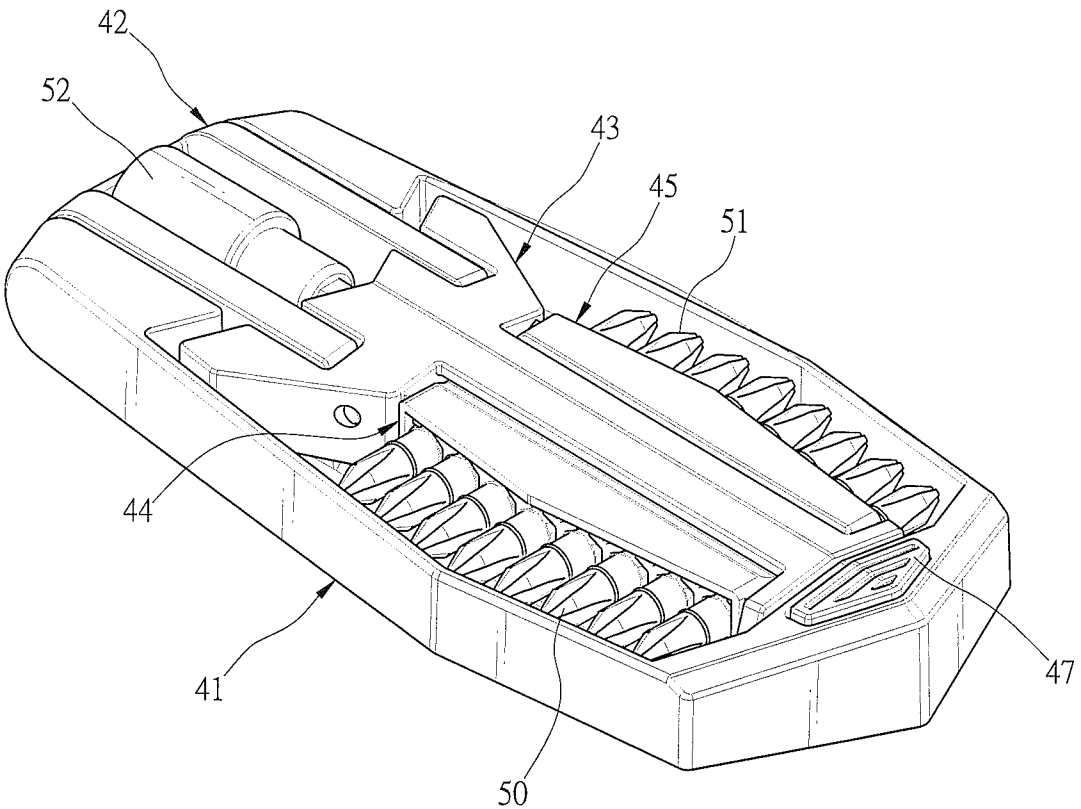
FIG. 6 is a perspective view showing the assembly of the tool box according to the preferred embodiment of the present invention.
Figure 7:
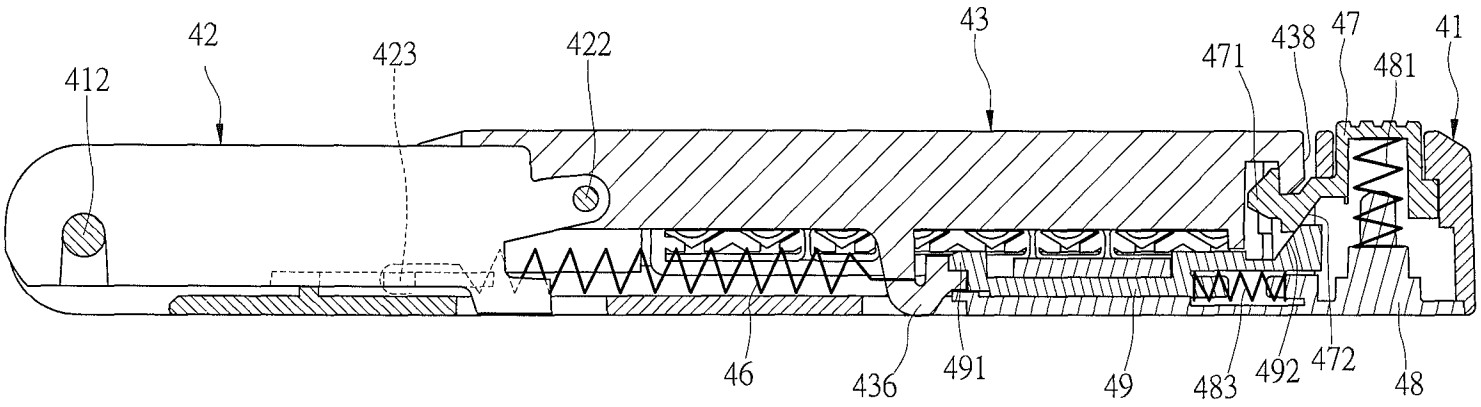
FIG. 7 is a cross sectional view showing the assembly of a part of the tool box according to the preferred embodiment of the present invention.

With reference to FIGS. 5 to 7, a tool box according to a preferred embodiment of the present invention comprises: a body 41 with a lifting mechanism. In this embodiment, the body 41 includes a receiving space 411 defined therein so as to receive the lifting mechanism. The lifting mechanism includes a rotating assembly and a guiding member. The rotating assembly has a first end disposed in the body 41 and a second end mounted in the guiding member. In this embodiment, the rotating assembly has a first pivoting member 42 and a second pivoting member 43 pivoting with the first pivoting member 42. The lifting mechanism also includes a first hole 421 formed a first end of the first pivoting member 42 and pivoting with a first shaft 412 of a front end of the body 41, such that the first pivoting member 42 rotates along the body 41; a second shaft 422 fixed on a second end of the first pivoting member 42; a second hole 431 defined on a first end of the second pivoting member 43 and pivoting with the second shaft 422 of the first pivoting member 42, such that the second pivoting member 43 rotates along the first pivoting member 42; a sliding member 432 secured on a second end of the second pivoting member 43; the guiding member 413 disposed in the receiving space 411 of the body 41 and having the sliding member 432 fitted and moving therein, such that the first pivoting member 42 and the second pivoting member 43 rotate and move in a crank-slider moving manner; at least one holder used to hold at least one tool set and mounted on any one of the first pivoting member 42 and the second pivoting member 43. In this embodiment, the at least one holder is fixed on the second pivoting member 43 and has a first seat 44 and a second seat 45, wherein the first seat 44 has two third holes 441 defined on two ends thereof and a plurality of first grooves 442 formed on two peripheral sides thereof so as to hold a first tool set 50. The second pivoting member 43 has a third shaft 433 secured on a front side thereof and pivoting with the third hole 441 of the first seat 44, such that the first seat 44 is pivoted on the front side of the second pivoting member 43, and a connecting piece 435 of the second pivoting member 43 abuts against the first seat 44, such that the first seat 44 does not turn downwardly relative to the second pivoting member 43 when holding the first tool set 50. The second seat 45 has two fourth holes 451 formed on two ends thereof and a plurality of second grooves 452 defined on two peripheral sides thereof so as to hold a second tool set 51. The second pivoting member 43 has a fourth shaft 434 secured on a rear side thereof and pivoting with the fourth hole 451 of the second seat 44, such that the second seat 45 is pivoted on the rear side of the second pivoting member 43, and the connecting piece 435 of the second pivoting member 43 abuts against the first seat 44, such that the second seat 45 does not turn downwardly relative to the second pivoting member 43 when holding the second tool set 51. Thereby, the first seat 44 and the second seat 45 lift and rotate simultaneously to move away from the body 41 when the second pivoting member 43 rotates and lifts. The body 41 also includes a controlling mechanism, and the controlling mechanism includes at least one resilient element for driving the rotating assembly to rotate and a control member disposed in the body. In this embodiment, the resilient element is an extension spring 46, wherein a first end of the extension spring 46 is disposed on a rib plate 423 of the first pivoting member 42, and a second end of the extension spring 46 is mounted on a hook 436 of the second pivoting member 43, such that the first pivoting member 42 and the second pivoting member 43 are pushed and pulled by the extension spring 46 to rotate on the body 41. The control member 47 is applied to position and store the first pivoting member 42 and the second pivoting member 43 in the body 41. In this embodiment, the control member 47 has a retainer 471 secured on a rear end of the body 41 and engaging with a stop piece 438 of the second end of the second pivoting member 43, such that the first pivoting member 42 and the second pivoting member 43 are stored and positioned in the body 41. In addition, a support plate 48 is locked on the body 41 and located below the control member 47, the support plate 48 has a first compression spring 481 for biasing against the control member 47, such that the control member 47 is pressed and released to engage with and disengage from the stop piece 438 of the second pivoting member 43 by ways of the first compression spring 481. Furthermore, the tool box also comprises an auxiliary positioning mechanism, and the auxiliary positioning mechanism includes a recess defined on the body 41 so as to receive a moving member 49 with a second compressing spring 483. In this embodiment, the support plate 48 has the recess 482 defined thereon so as to receive the moving member 49. The moving member 49 has a shoulder 491 formed on a first end thereof and engaging with the hook 436 of the second pivoting member 43 and has a tilted guiding face 492 defined on a second end thereof and contacting with a beveled contacting face 472 of the retainer 471 of the control member 47, such that when the control member is pressed to disengage from the stop piece 438 of the second pivoting member 43, and the beveled contacting face 472 pushes the tilted guiding face 492 of the moving member 49 so that the moving member 49 slides backward along the recess 482 and presses the second compression spring 483, and then the shoulder 491 of the moving member 49 disengages from the hook 436 of the second pivoting member 43. The tool box further comprises a turning mechanism, and the turning mechanism includes at least one pushing piece mounted on the first pivoting member 42 so as to push the at least one holder to turn upwardly. In this embodiment, the turning mechanism includes a first pushing piece 424 and a second pushing piece 425 fixed on two sides of the second end of the first pivoting member 42, wherein when the second pivoting member 43 drives the first seat 44 to lift toward a first terminal point, the first pushing piece 424 pushes a bottom end of the first seat 44 so that the first seat 44 turns upwardly and faces outwardly along the third shaft 433, thus taking and placing the first tool set 50 easily. In addition, when the second pivoting member 43 drives the second seat 45 to lift toward a second terminal point, the second pushing piece 425 pushes a bottom end of the second seat 45 so that the second seat 45 turns upwardly and faces outwardly along the fourth shaft 433, thus taking and placing the second tool set 51 easily. The second pivoting member 43 further has a notch 437 formed on the first end of the second pivoting member 43 so as to receive a driving tool 52, and the second pivoting member 43 drives the driving tool 52 to rotate and lift so that a user take and place the driving tool 52 from and into the notch 437 easily.

Figure 8:
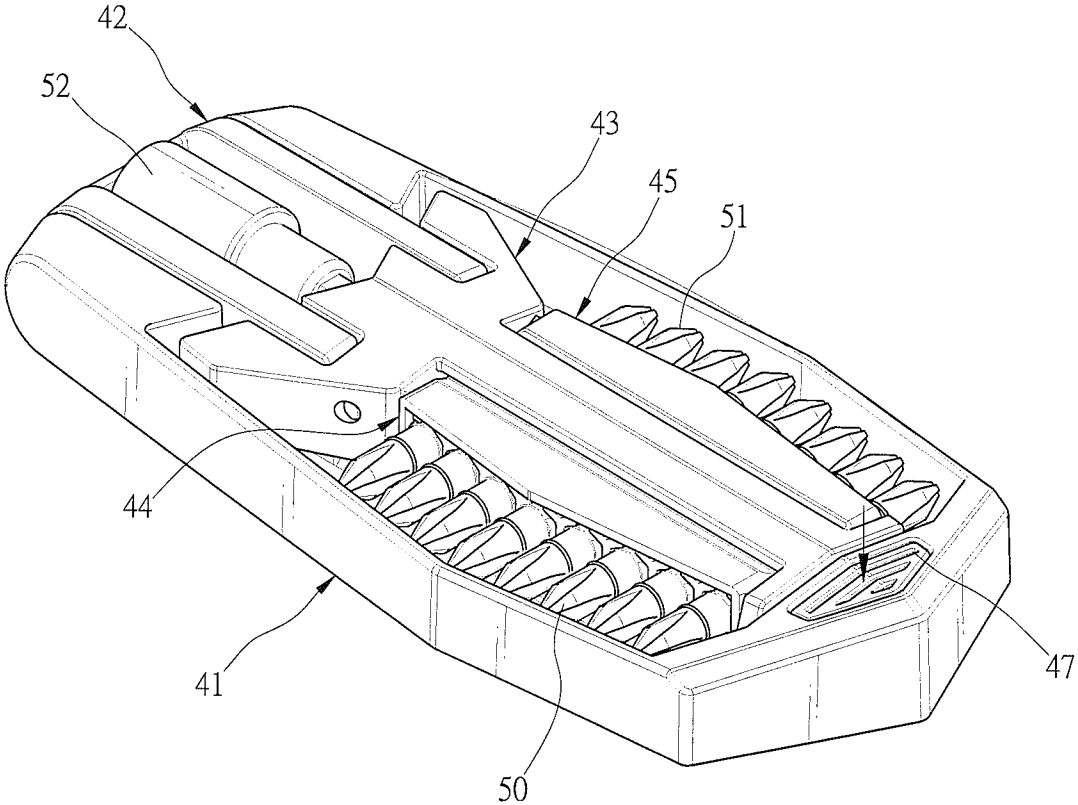
FIG. 8 is a perspective view showing the operation of the tool box according to the preferred embodiment of the present invention.
Figure 9:
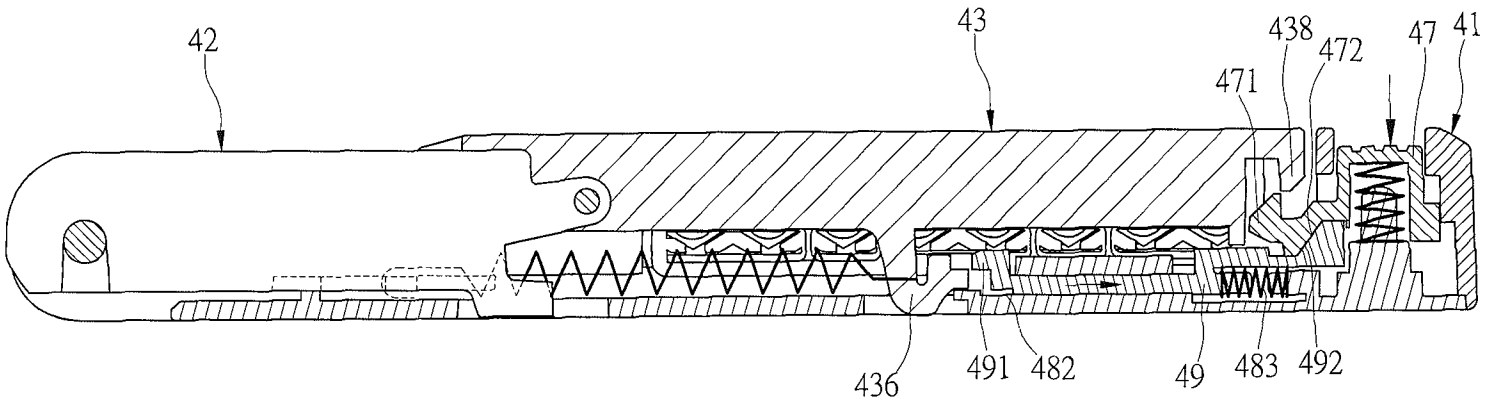
FIG. 9 is a cross sectional view of a part of FIG. 8.

Referring further to FIGS. 8 and 9, as opening the tool box to take the tool set, the control ember 47 is pressed so that the retainer 471 moves downwardly and disengages from the shoulder 438 of the second pivoting member 43, and the beveled contacting face 472 pushes the tilted guiding face 492 of the moving member 49, such that the moving member slides backward along the recess 482 and presses the second compression spring 483, and then the shoulder disengages from the hook 436 of the second pivoting member 43, thereby the second end of the second pivoting member 43 is released.

Figure 10:
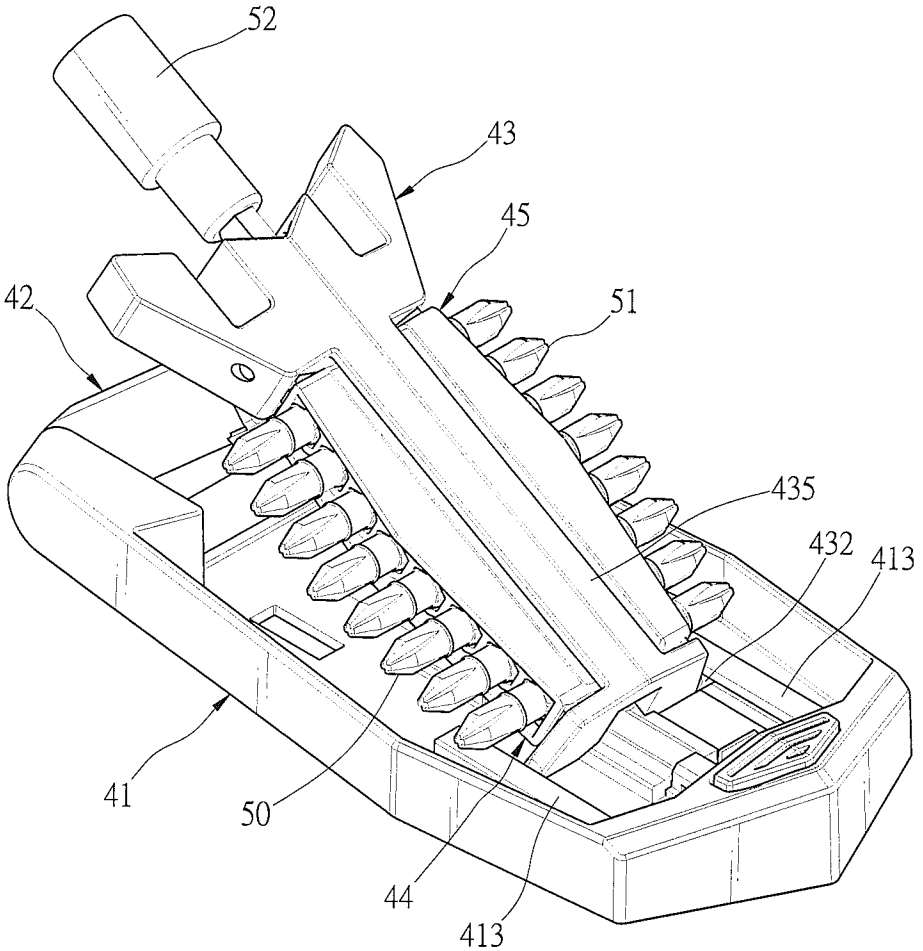
FIG. 10 is another perspective view showing the operation of the tool box according to the preferred embodiment of the present invention.
Figure 11:
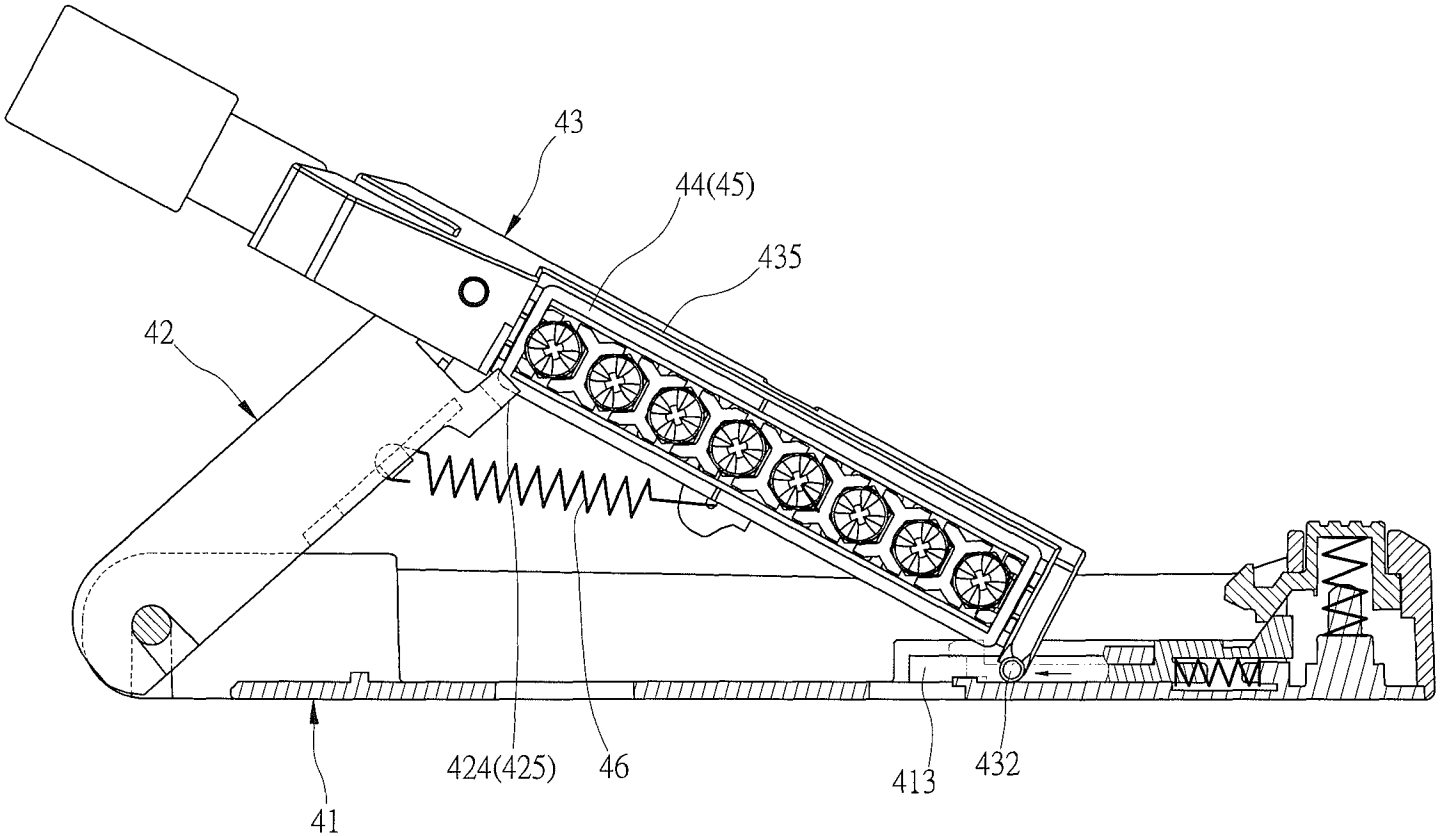
FIG. 11 is a cross sectional view of a part of FIG. 10.

As shown in FIGS. 10 and 11, after the second end of the second pivoting member 43 is released, the extension spring 46 pushes the sliding member 432 to slide along the guiding member 413 and drives the first pivoting member 42 and the second pivoting member 43 to have a crank-slider movement on the body 41, such that the first pivoting member 42 and the second pivoting member 43 rotate and lifts upwardly on the body 41 and drives the first seat 44 and the second seat 45 to lift and rotate simultaneously.

Figure 12:
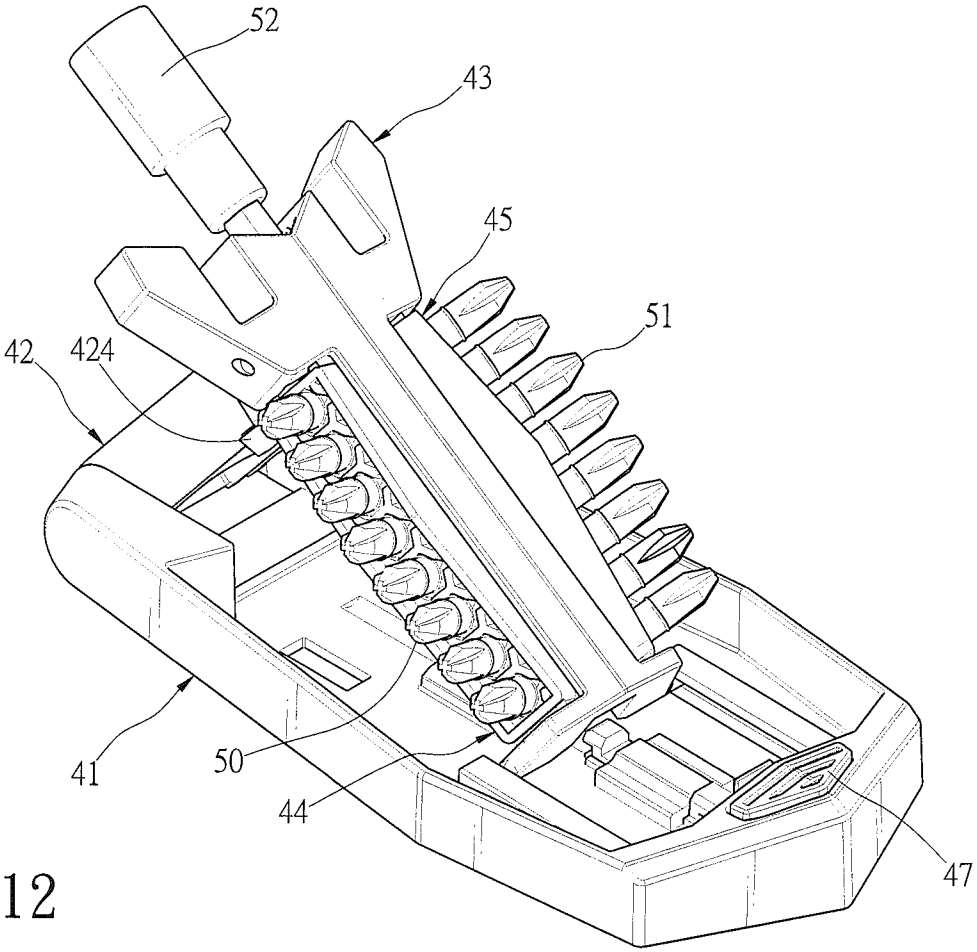
FIG. 12 is also another perspective view showing the operation of the tool box according to the preferred embodiment of the present invention.
Figure 13:
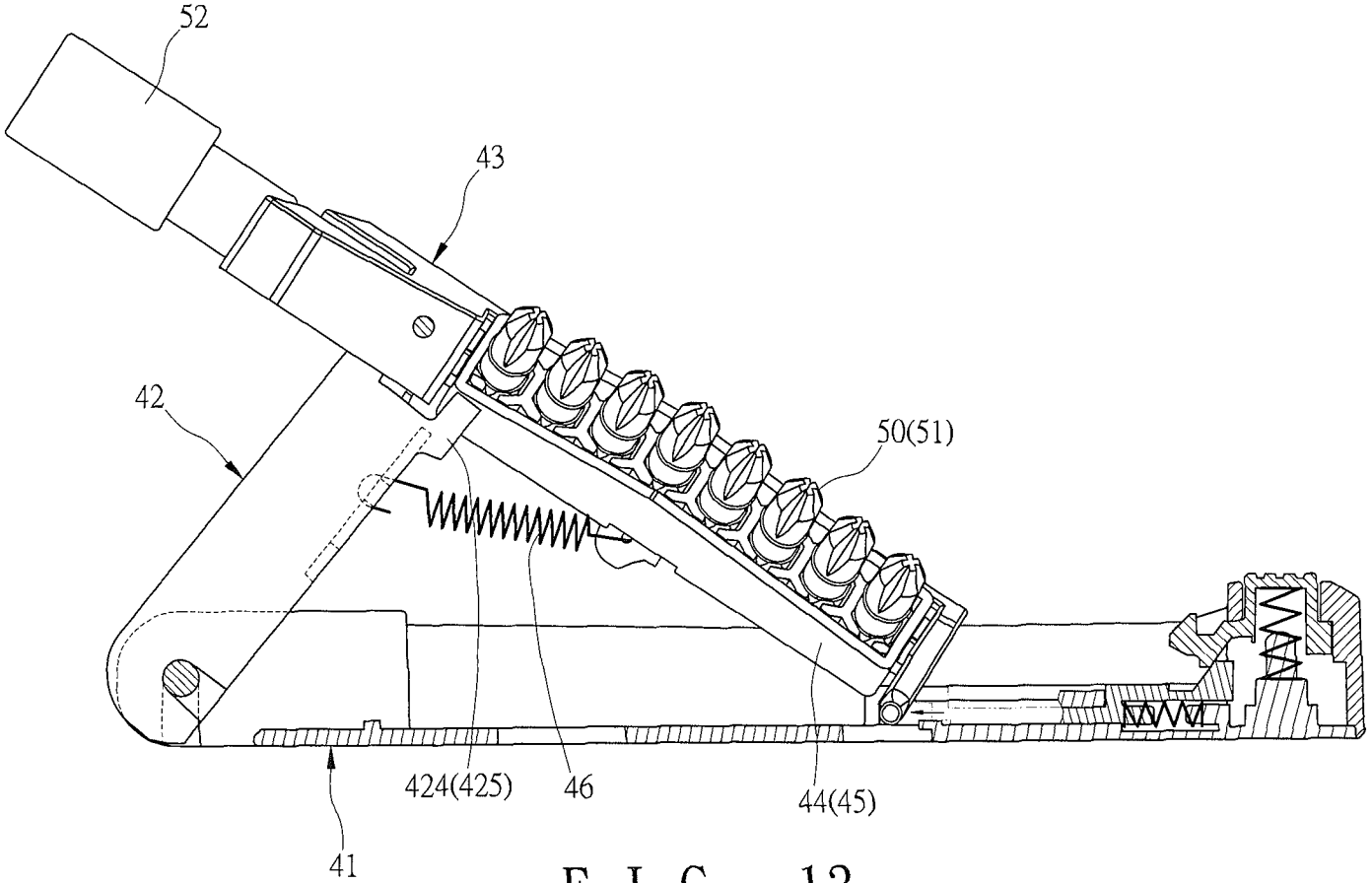
FIG. 13 is a cross sectional view of a part of FIG. 12.

As illustrated in FIGS. 12 and 13, when the second pivoting member 43 drives the first seat 44 to lift toward the first terminal point, the first pushing piece 424 pushes the bottom end of the first seat 44 so that the first seat 44 turns upwardly and faces outwardly along the third shaft 433, thus taking and placing the first tool set 50 easily. And, when the second pivoting member 43 drives the second seat 45 to lift toward the second terminal point, the second pushing piece 425 pushes the bottom end of the second seat 45 so that the second seat 45 turns upwardly and faces outwardly along the fourth shaft 433, thus taking and placing the second tool set 51 easily. Also, the first tool set 50 can be placed in the second seat 45, and the second tool set 51 can be placed in the first seat 44. The control member 47 is applied to engage and disengage the first seat 44 and the second seat 45 easily.

Figure 14:
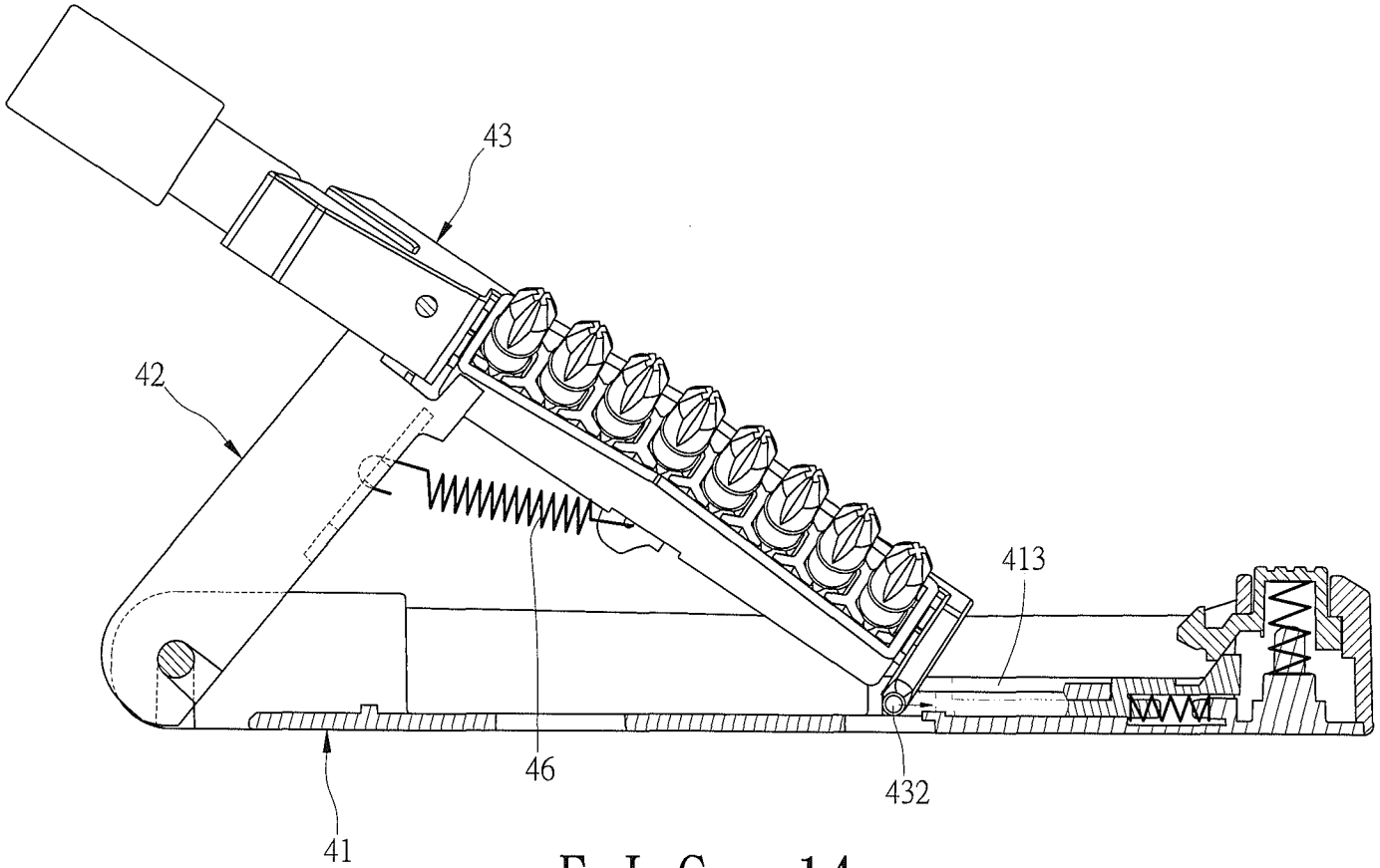
FIG. 14 is still another perspective view showing the operation of the tool box according to the preferred embodiment of the present invention.

With reference to FIG. 14, the first pivoting member 42 and the second pivoting member 43 is pressed to rotate downwardly, and then the sliding member 432 of the second pivoting member 43 slides adversely along the guiding member 413, and as shown in FIGS. 10 and 11, the first pushing piece 424 and the second pushing piece 425 do not push bottom ends of the first seat 44 and the second seat 45, so that the first seat 44 and the second seat 45 turn downwardly to contact with the connecting piece 435 and turn back to a plane angle relative to the second pivoting member 43, thereafter the first pivoting member 42 or the second pivoting member 43 is pressed as shown in FIGS. 6 and 7 so that the first pivoting member 42 and the second pivoting member 43 are stored and fixed in the body 41.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool box comprising:

a body;

a lifting mechanism fixed on the body and including a rotating assembly and a guiding member, the rotating assembly having a first end disposed in the body and a second end mounted in the guiding member so as to rotate on the body;

at least one holder used to hold at least one tool set and mounted on the rotating assembly of the lifting mechanism, such that the at least one holder is driven by the rotating assembly to lift and rotate;

a controlling mechanism including at least one resilient element for driving the rotating assembly to rotate and a control member disposed in the body, such that the rotating assembly of the lifting mechanism is positioned on the body.

2. The tool box as claimed in claim 1, wherein the rotating assembly has a first pivoting member and a second pivoting member pivoting with the first pivoting member, a first end of the first pivoting member is pivoted with the body, and the second pivoting member has a sliding member secured on a second end thereof, fitted and moving in the guiding member.

3. The tool box as claimed in claim 2, wherein the at least one holder is fixed on the second pivoting member and has a plurality of grooves formed on two peripheral sides thereof so as to hold the at least one tool set.

4. The tool box as claimed in claim 3 further comprising a turning mechanism, and the turning mechanism including at least one pushing piece mounted on a second end of the first pivoting member so as to push the at least one holder to turn upwardly and to face outwardly.

5. The tool box as claimed in claim 3, wherein the at least one holder has a first seat and a second seat, and the first seat is pivoted on a front side of the second pivoting member, the second seat is pivoted on a rear side of the second pivoting member.

6. The tool box as claimed in claim 5, wherein the second pivoting member has a connecting piece pivoting member for abutting against the first seat and the second seat, such that the first seat and the second seat do not turn downwardly relative to the second pivoting member.

7. The tool box as claimed in claim 2, wherein the resilient element of the controlling mechanism is an extension spring, wherein a first end of the extension spring is disposed on the first pivoting member, and a second end of the extension spring is mounted on the second pivoting member, such that the first pivoting member and the second pivoting member are pushed and pulled by the extension spring to rotate on the body.

8. The tool box as claimed in claim 2, wherein the control member of the controlling mechanism has a retainer secured on a rear end of the body, a first compression spring locked on the body and located below the control member so as to abut against the control member, such that the retainer engages with the second end of the second pivoting member, and the first pivoting member and the second pivoting member are stored and positioned in the body.

9. The tool box as claimed in claim 8 further comprising an auxiliary positioning mechanism, and the auxiliary positioning mechanism including a recess defined on the body so as to receive a moving member with a second compressing spring, the moving member having a shoulder formed on a first end thereof and engaging with the second pivoting member and having a tilted guiding face defined on a second end thereof and contacting with a beveled contacting face of the retainer of the control member.

10. The tool box as claimed in claim 2, wherein the second pivoting member further has a notch formed on a first end of the second pivoting member so as to receive a driving tool, and the second pivoting member drives the driving tool to rotate and lift.

* * * * *